United States Patent [19]

Smith et al.

[11] 4,103,445

[45] Aug. 1, 1978

[54] ROLL-UP SIGN

[76] Inventors: David A. Smith, 200 Columbus St.; Thomas P. Hertrick, 859 Sherwood Dr., both of Elyria, Ohio 44035

[21] Appl. No.: 719,687

[22] Filed: Sep. 2, 1976

[51] Int. Cl.[2] ..... G09F 7/00

[52] U.S. Cl. ..... 40/125 G; 40/607; 160/378; 248/156; 40/610

[58] Field of Search ..... 40/125 G, 125 H, 125 R, 40/145 R, 125 F, 155; 248/150, 156; 160/377, 378; 52/103, 155; 273/102, 29 BC, 181 R, 181 F; 135/3 R, 5 R, 15; 428/12, 230

[56] References Cited

U.S. PATENT DOCUMENTS

| | | | |
|---|---|---|---|
| 410,020 | 8/1889 | Presley | 52/155 |
| 965,097 | 7/1910 | Fisher | 40/125 G |
| 1,325,519 | 12/1919 | Jenkins | 40/125 G |
| 1,605,056 | 11/1926 | Newman | 428/38 |
| 2,048,359 | 7/1936 | Snell | 40/155 X |
| 2,292,785 | 8/1942 | Henne | 40/10 C |
| 2,703,890 | 3/1955 | Rinaldy | 248/156 |
| 2,722,420 | 11/1955 | Adamson | 40/155 |
| 2,899,204 | 8/1959 | Ratay | 40/125 H |
| 3,042,053 | 7/1962 | Gabriel | 135/5 R |
| 3,195,898 | 7/1965 | Respimi | 248/156 |
| 3,289,337 | 12/1966 | Golkowski | 40/125 H |
| 3,591,940 | 7/1971 | Slemmons | 40/125 G |

OTHER PUBLICATIONS

"A Hot One to Watch", Plastics Technology, vol. 18, Jul.-Dec., 1972, p. 11.

"Those TP Elastomers are Stirring up a Frenzy", Plastics Technology, vol. 19, 1973, p. 38.

*Primary Examiner*—Russell R. Kinsey
*Assistant Examiner*—John J. Wilson
*Attorney, Agent, or Firm*—McNenny, Pearne, Gordon, Gail, Dickinson & Schiller

[57] ABSTRACT

A portable sign assembly comprising a rigid knock-down frame and a flexible display web. In a collapsed condition elements of the sign assembly afford a relatively small package size which is conveniently handled and economically shipped. The sign is quickly assembled and disassembled by simple manipulation of the frame elements. In accordance with an important aspect of the invention, the display web is provided with relatively high elastic elongation properties and the frame is arranged to slightly stretch the web to thereby completely tension it and ensure that it is drawn into a planar configuration.

11 Claims, 7 Drawing Figures

ROLL-UP SIGN

BACKGROUND OF THE INVENTION

The invention relates to a portable sign assembly and, more specifically, to the type of sign in which the display medium is collapsible for transport and storage.

PRIOR ART

In the past, collapsible signs have often required tedious and time-consuming steps for their assembly and disassembly. In the case of signs employing a foldable or otherwise collapsible display medium, canvas or a similar fabric-based material has ordinarily been used. Such fabric sign structures, owing to limitations in their quality of appearance and durability, have been generally restricted to use for very temporary periods and, typically, for advertisement of goods or services of limited value.

A specific example of an area in which collapsible panel signs have heretofore been generally excluded is outdoor real estate signs to advertise the availability of a site and the identity of the owner or agent. Such real estate signs have customarily been fabricated with a rigid perimeter frame, usually a weldment of steel channel, angle, and/or tube, and with a steel display panel rigidly secured to the frame. Signs of the latter type are relatively expensive to manufacture, due to both labor and material cost, and expensive to transport because of their weight and bulk. Moreover, such rigid signs are not conveniently stored or handled by personnel. These signs have the additional disadvantage of being readily defaced by blows struck by vandals and other deterioration such as by corrosion.

SUMMARY OF THE INVENTION

The invention provides a portable sign assembly which combines a flexible display panel or web having unique physical properties with a complementary, knockdown type of frame, and which affords a display unit particularly useful in outdoor advertising. The disclosed sign assembly is readily assembled and erected, as well as removed and folded up, with minimum time and effort. Moreover, the unique properties of the disclosed display panel medium assure that the sign presents an attractive quality appearance during extended periods of outdoor use.

In accordance with an important aspect of the invention, the collapsible display panel is formed of rubber-like material having a high elastic elongation capacity. The elongation characteristic or stretchability of the panel medium is put to full advantage by the frame elements, which automatically tension the panel as they are forced into the ground. The construction of the various sign elements permits the display panel to be tensioned across its full width so that it is drawn into a flat or planar configuration and sagging or other unsightly distortion of the display panel is positively avoided. The high elasticity rate or stretchability assures that the panel will remain tensioned, and therefore straight, throughout its service at a particular installation regardless of changes in temperature, variable wind loads, settling of the soil area supporting it, mild blows from objects hurled at it, and like disturbances.

Preferably, the disclosed frame comprises a pair of identically formed vertical legs and an intermediate crosspiece releasably joined at interlocking points without fasteners or other separate means, and with minimum physical effort and manipulation. The disclosed sign assembly is inexpensive to manufacture as a result of its exceptionally simple design and selected component materials, and is both economical to ship and readily carried by personnel due to its low weight and minimum collapsed bulk.

DESCRIPTION OF THE PREFERRED EMBODIMENT

Figure 1:
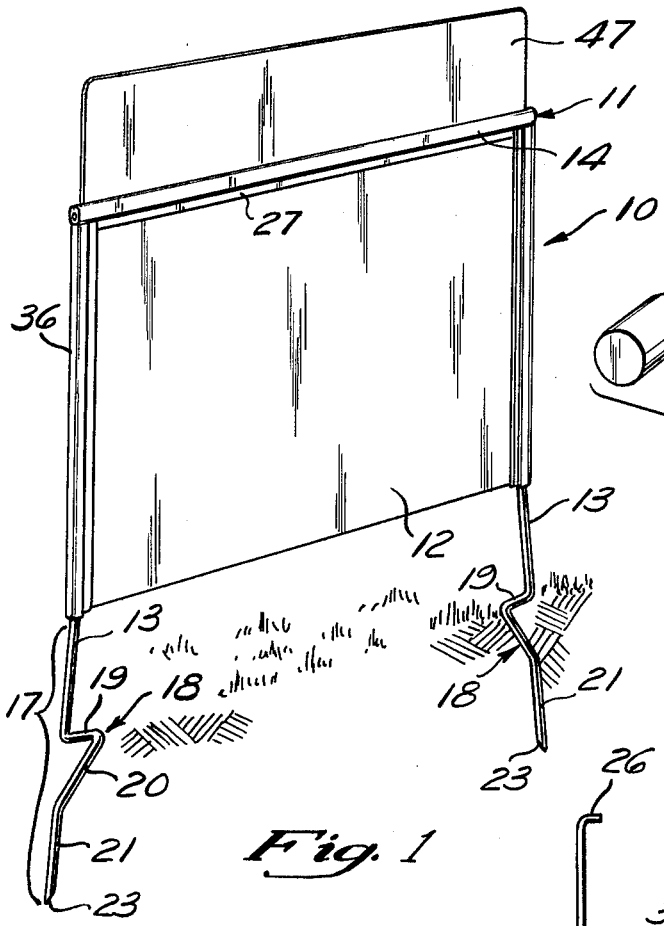
FIG. 1 is a perspective view of a sign assembly constructed in accordance with the present invention.

With reference to the drawing, there is shown a sign assembly 10 comprising a rigid knockdown frame 11 and a collapsible display panel 12.

Figure 7:
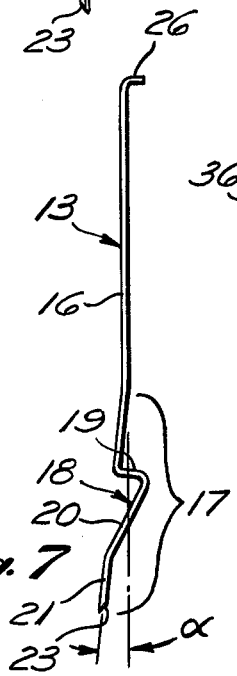
FIG. 7 illustrates details of the construction of a leg.

The frame 11 includes a pair of elongated, vertical legs 13 and an elongated, horizontal crosspiece 14 extending between the legs. The legs 13 are essentially identical and are fabricated of solid round steel bar stock, bent into the shape illustrated most clearly in FIG. 7. An upper leg portion 16 is generally straight and forms the greater part of the length of the leg 13. A lower part 17 of the leg 13 includes a laterally bent offset portion 18 disposed in the plane of the sign assembly and forming a foot pedal for driving the leg into the ground. A generally horizontal segment 19 of the offset 18 provides a foot step, while an angularly depending segment 20 when forced into the ground stabilizes the leg.

The entire lower leg part 17, or at least a leading or lowermost section 21 of the leg, is canted at a slight angle $\alpha$, e.g., 5° laterally outwardly, like the offset 18, in the plane of the sign assembly 10. An extreme lower end 23 of the leg 13 is ideally pointed by cutting the bar stock at an angle or otherwise tapering it to minimize the effort required to implant the lower leg areas 21 and 20 into the ground. A relatively short, lateral extension 26 is formed at the end of the upper leg portion 16 by bending a short element of the bar stock at a right angle to the leg in the plane of the offset portion 18 to form a hook.

The illustrated crosspiece 14 (FIG. 5) is a hollow extrusion or tube formed of rigid plastic such as polyvinyl chloride or like material. The crosspiece 14 has a generally O-shaped cross section, with spaced skirts 27 depending integrally from a lower wall 28 of the crosspiece. An interior, oblong bore 29 of the crosspiece has a major vertical dimension somewhat larger than the diameter of the bar stock of the leg 13 and a minor horizontal dimension approximately equal to the leg bar stock diameter.

Figure 5:
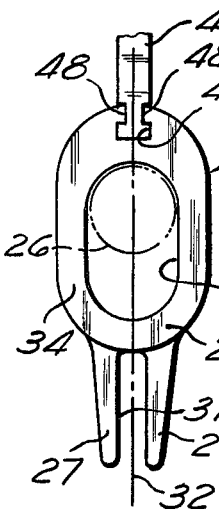
FIG. 5 is an end view of the crosspiece illustrating its extruded cross section.
Figure 4:
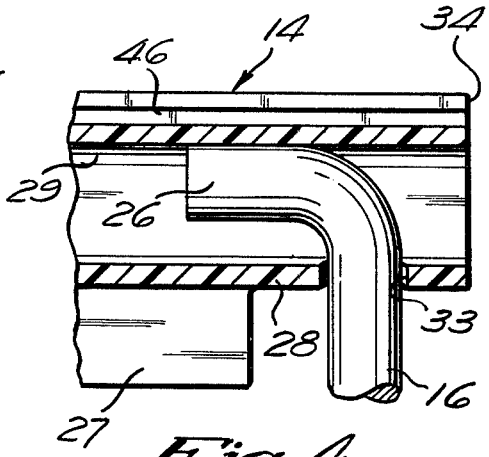
FIG. 4 is an enlarged, fragmentary view of respective end areas of a leg and crosspiece in interlocked relation.

The depending skirts 27 form a panel receiving channel 31 running lengthwise of the crosspiece 14 and centered on an imaginary vertical plane of symmetry of the crosspiece corresponding to the plane of the sign assembly 10 and indicated at 32 in FIG. 5. As shown in FIG. 4; the skirts 27 are removed by machining or other operation for a limited length at the ends of the crosspiece 14 to provide clearance for the upper leg portion 16. An aperture 33 is drilled or otherwise formed through the lower crosspiece wall 28 adjacent each end face 34 of the crosspiece. The diameter of the aperture 33 is slightly larger than the diameter of the leg 13, allowing the aperture to form an eye for the hook 26.

The collapsible display panel 12 is a flexible web formed, in accordance with the invention, of a sheet or rubberlike material, and preferably of thermoplastic rubber such as that marketed under the registered trademark TPR by Uniroyal, Inc. For a display face between the legs 13 of approximately 25 inches in width and 20 inches in height, material of a thickness of one-sixteenth inch is suitable. Typical mechanical properties of this material are elasticity of 3½ inches per inch and elastic elongation of 350%, based on A.S.T.M. D412. A sheet of panel material somewhat wider than the actual display face is provided to enable the vertical ends to be wrapped in direct contact about the upper leg portions 16.

Figure 6:
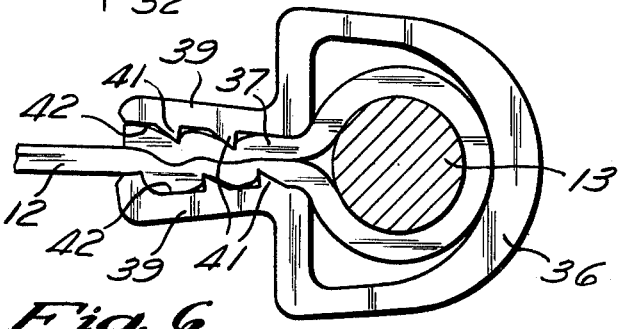
FIG. 6 is an end view of a retaining clip member for securing respective sides of the collapsible panel to the frame legs.

As indicated in FIG. 6, vertical edges 37 of the display panel material are wrapped about the leg 13 and retained thereon by a pair of extruded, elongated clips 36, one associated with each leg. The retaining clips 36 are formed with a horseshoe cross section. Integral longitudinally extending flanges 39 are formed in opposing relation on opposite sides of the horseshoe cross section. Ideally, webgripping barbs 41 are integrally formed lengthwise on inner faces 42 of the flanges 39. The length of each clip 36 is approximately equal to the vertical height of the display panel 12. The retaining clips 36, as viewed in FIG. 6, are stressed from their extruded or free state wherein the inner flange surfaces 42 are parallel and somewhat closer together. The tendency of the stressed clips 36 to decrease the spacing between these surfaces or faces 42 cause the vertical panel ends 37 to be tightly held in the illustrated position of FIG. 6.

Figure 3:
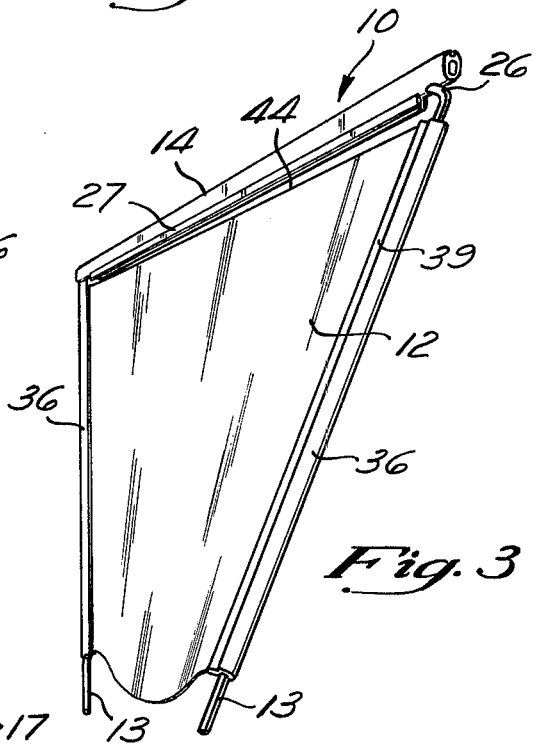
FIG. 3 illustrates the manner in which the legs of the frame are assembled and interlocked with the crosspiece of the frame.

As suggested in FIG. 3, with the vertical panel edges or ends 37 retained on the legs 13 by the clips 36, the sign 10 is assembled by successively inserting leg hook elements 26 into the apertures 31. More specifically, with the hook 26 of one leg (at the left in FIG. 3) assembled through its associated aperture 33 and received within the restricted zone defined by the immediately adjacent area of the oblong bore 29, the other leg 13 is initially positioned with its hook 26 at the rightward aperture 33 and its lower end portion 17 swung towards the left leg generally in the eventual plane of the sign as defined by the imaginary plane 32 of the crosspiece 14. With the hook 26 partially in the adjacent end of the oblong bore 29, the right leg is brought into a generally vertical position, causing the hook to slide fully into the oblong bore. An upper, horizontal edge 44 of the panel 12 (FIG. 3) is simultaneously or subsequently positioned within the crosspiece channel 31.

the disclosed sign assembly 10 is particularly suited for outdoor use, as in real estate advertising, wherein it is erected on a parcel of land for short or extended periods of use. Assuming that the sign is assembled as above, it is readily installed by positioning it at a desired location, with the legs 13 spread sufficiently apart to draw the display panel 10 into a reasonably fold-free configuration. Thereafter, the legs 13 are driven into the ground by stepping on the pedals 19. Driving the legs 13 into the ground is most advantageously accomplished by incrementally displacing each leg in alternate steps.

As will be understood from the foregoing description, the lowermost portions 21 of the legs, with the upper portions 16 generally vertical, are divergent from one another. As a result of this divergence between the lower leg end portions 21, while the legs 13 are driven downwardly, they are forced laterally away from one another by ground reaction forces, thereby drawing the panel into a tensioned condition. Desirably, the panel 12 is proportioned relative to the spacing of the leg apertures 33 of the crosspiece 14 such that the area of the panel adjacent the upper edge 44 is tensioned as soon as each leg 13 is hooked into the crosspiece so that upon relative spreading of the lower portions 17 of the legs, the entire sign is tensioned and stretched into a relatively flat or planar configuration. The elasticity provided by the disclosed panel material is particiularly advantageous with the disclosed frame construction, since it accommodates any necessary distortion when the legs are driven into the ground at relatively varying rates or steps, tending to force the sign into a trapezoidal or like configuration.

Further, the high elasticity rate of the panel medium, when the panel is properly tensioned, eliminates any possibility of sagging due to less-than-perfect installation, thermal expansion or contraction, shifting of the assembly under wind loads, or limited settling of the soil surrounding the implanted lower leg areas 20 and 21. Further, the leg hooks 26 are laterally supported by the sidewalls of the oblong bore 29 to thereby prevent the sign from twisting out of a planar configuration.

With respect to FIG. 5, the crosspiece 14 may be provided with an inverted, lengthwise extending tee-slot 46 in its upper wall. An auxiliary panel 47 is provided with slots 48 complementary to the inverted tee-slot 46, enabling it to be assembled on the crosspiece 14 by slipping it into the tee-slot 46 from one of the crosspiece end faces 32. The auxiliary panel or plate 47 is ideally formed as an extrusion to conveniently provide its slots 48. Preferably, the auxiliary panel 47 comprises a suitable plastic material such as rigid polyvinyl chloride.

Figure 2:
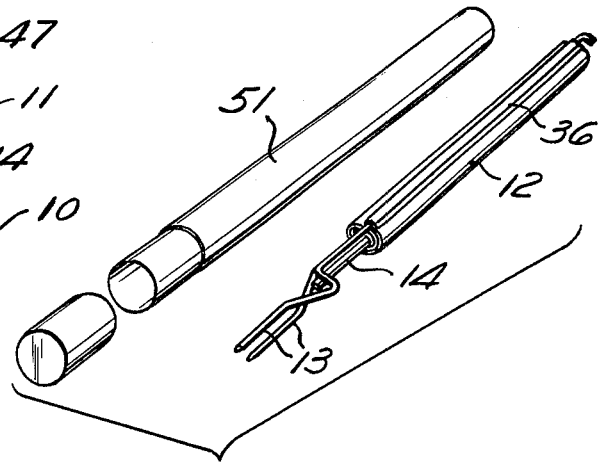
FIG. 2 is a perspective view of the sign assembly of FIG. 1 in a collapsed or rolled-up condition and a convenient shipping and storage tube for carrying the collapsed assembly.

The display panel 12 is imprinted with any desired message, symbol, or other intelligence, preferably by selectively depositing a suitable elastic paint or ink. With reference to FIG. 2, the sign assembly is advantageously shipped and stored in a cylindrical rigid container, such as a conventional mailing tube 51. The sign assembly 10 is readily prepared for insertion into the container 51 by wrapping or rolling up the panel 12, with the legs 13 secured to its edges by the clips 36, on itself and the crosspiece 14. It is contemplated, where desired, that other means for securing the panel edges 37 to the legs 13 may be employed, such as by folding the ends over themselves to form leg receiving tubes and permanently maintaining this tube configuration by sewing or heat fusing a seam along the length of the edges.

The invention is not restricted to the slavish imitation of each and every detail set forth above. Obviously, devices may be provided which change, eliminate, or add certain specific details without departing from the scope of the invention.

What is claimed is:

1. A sign for outdoor display comprising a rigid frame and a flexible web for carrying an image, the frame members including an elongated crosspiece and a pair of elongated legs for supporting the crosspiece, said web being sufficiently flexible to be rolled on itself, means for securing the web to the frame, the upper end portion of each leg being adapted to interengage opposite end portions of the crosspiece, means on the end portion of one of said frame members at both ends of said crosspiece for releasably interlocking the respective leg and crosspiece end portions together, said releasable interlocking means being constructed and arranged to permit both locking interengagement and release of said crosspiece and leg end portions while said web is secured to said frame by said securing means, said interlocking means preventing separation of each of said upper leg end portions from its associated crosspiece end portion under tensile forces between such leg end portions and respective crosspiece end portions when the lower end portions of said legs are embedded in the ground, said interlocking means comprising on one frame at each end of the crosspiece an enclosed receiving zone extending axially along the associated member and an aperture communicating with the receiving zone, said aperture lying in a plane generally perpendicular to the axis of the receiving zone, the other frame member at each end of the crosspiece having a relatively short extension transverse to a principal longitudinal direction thereof, said zone and aperture being dimensioned to permit said transverse extension to be inserted into said receiving zone through said aperture, said crosspiece and leg members being constructed and arranged such that when fully assembled each transverse extension is retained in an associated receiving zone in a manner wherein said leg members are generally perpendicular to said crosspiece while each transverse extension is generally parallel to the longitudinal direction of the member providing the receiving zone at each end of the crosspiece, each aperture being sufficiently closed with respect to the size of the associated transverse extension to prevent removal of such associated extension from its respective receiving zone when the associated leg is generally perpendicular to the crosspiece.

2. A sign as set forth in claim 1, wherein said legs provide said transverse extensions at their respective upper portions, each of said legs having a lower portion laterally offset from a generally longitudinal direction and generally in the plane of the associated transverse extension, said lower laterally offset portions each providing a footstep and being adapted to be driven into the ground to improve stabilization of the sign.

3. A sign for outdoor display comprising a rigid frame and a flexible web for carrying an image, the frame members including an elongated crosspiece and a pair of elongated legs for supporting the crosspiece, said web being constructed of thermoplastic rubber whereby the web is sufficiently flexible to be rolled on itself, means for securing the web to the frame, the upper end portion of each leg being adapted to interengage opposite end portions of the crosspiece, means on the end portion of one of said frame members at both ends of said crosspiece for releasably interlocking the respective leg and crosspiece end portions together, said releasable interlocking means being constructed and arranged to permit both locking interengagement and release of said crosspiece and leg end portions while said web is secured to said frame by said securing means, said interlocking means preventing separation of each of said upper leg end portions from its associated crosspiece end portion under tensile forces between such leg end portions and respective crosspiece end portions when the lower end portions of said legs are embedded in the ground, each of said legs including lower end means extending laterally at a slight angle in a direction away from the opposite leg whereby said legs are caused to be separated by ground reaction forces as said lower end means are driven into the ground, said web being secured to said legs whereby said web is stretched and thereby tensioned throughout substantially its full area by said legs as said lower end means are driven into the ground.

4. A collapsible sign comprising a rigid frame and a web for displaying intelligence, said web being formed of thermoplastic rubber, elements of the frame including a pair of vertical legs and a horizontal crosspiece for extension between the legs, means for connecting the legs to opposite ends of the crosspiece, means for securing opposite ends of the web to the legs with each end of said web being secured along a major portion of its vertical extent, said legs being constructed and arranged to permit relative movement therebetween with the web secured thereto in order to tension and thereby stretch the web into a planar configuration solely by means carried on the frame, said web being formed of a thermoplastic rubber whereby the web may be rolled on itself during periods of nonuse and whereby substantially all of the web may be tensioned regardless of nonuniform stretching of the web, said connecting means being constructed and arranged to permit said legs to be displaced from one another after connection of said legs to said crosspiece, whereby said legs are adapted to tension said web as they are displaced laterally outwardly from one another, and means on the legs to spread the lower portion of the legs laterally outwardly from one another when said legs are driven into the ground.

5. A sign as set forth in claim 4, wherein said crosspiece is disposed at the upper ends of said legs.

6. A portable outdoor sign comprising a frame and a display web, the frame including an elongated, rigid, horizontal crosspiece and a pair of elongated, rigid, vertical legs, the legs each having a lateral extension forming a hook at an upper end, a lateral offset forming a foot pedal at a midportion and a slightly canted portion at a lower end, each end of the crosspiece having a receiving eye for releasable interlocking engagement with the hook of the leg, said display web being formed of a relatively flexible and elastic rubberlike material, means securing vertical edges of the web to the legs, said lower leg end portions being adapted to be driven into the ground upon application of foot force on the foot pedal portion, the canted orientation of the lower leg portions causing the legs to be separated relative to one another when driven into the ground, thereby tensioning and stretching the web into a planar configuration.

7. A portable sign as set forth in claim 6, wherein said web securing means comprises an elongated resilient retaining clip at each vertical edge of the web, each clip extending substantially along the full length of the vertical web edge.

8. A portable sign as set forth in claim 7, wherein said retaining clips are extruded members having a horseshoe-like cross section adapted to be assembled over a relatively straight upper area of each leg.

9. A portable sign as set forth in claim 8, wherein said crosspiece includes depending skirts forming a channel for receiving an upper horizontal edge of the web.

10. A portable sign as set forth in claim 6, wherein a perimeter of the sign is defined by horizontal and vertical surfaces extending around a face of the display web, one of said perimeter surfaces including lengthwise extending first surface means, and an auxiliary display panel having at one longitudinal edge a second surface means complementary to and interlocking with said first surface means, said auxiliary panel being assembled on said sign by sliding said second surface means lengthwise along and progressively into interlocking engagement with said first surface means.

11. A portable sign as set forth in claim 10, wherein said first surface means is a tee-slot formed lengthwise along the upper side of said horizontal crosspiece.

* * * * *